United States Patent [19]

Lubitz et al.

[11] Patent Number: 4,824,335

[45] Date of Patent: Apr. 25, 1989

[54] MODULAR HIGH PRESSURE PUMP

[75] Inventors: Klaus Lubitz, Meppen; Wolfgang Suttner, Bielefeld, both of Fed. Rep. of Germany

[73] Assignee: Elektra-Beckum Lubitz & Co., Fed. Rep. of Germany

[21] Appl. No.: 150,209

[22] Filed: Jan. 29, 1988

[30] Foreign Application Priority Data

Feb. 21, 1987 [DE] Fed. Rep. of Germany ..... 3705608

[51] Int. Cl.[4] ..... F04B 37/12; F04B 39/12

[52] U.S. Cl. ..... 417/360; 417/418; 417/454; 417/536

[58] Field of Search ..... 417/415, 418, 307, 311, 417/359, 454, 534, 535, 536, 537, 360, 567, 568

[56] References Cited

U.S. PATENT DOCUMENTS

| | | | |
|---|---|---|---|
| 2,759,665 | 8/1956 | Wilber | 417/534 X |
| 2,771,037 | 11/1956 | Johnston | 417/536 X |
| 3,279,391 | 10/1966 | Masciopinto | 417/536 X |
| 3,472,171 | 10/1969 | Sadler | 47/536 |
| 3,697,197 | 10/1972 | Berglund et al. | |
| 4,021,152 | 5/1977 | Toyoda | 417/311 X |
| 4,104,007 | 8/1978 | Hehl | 417/360 |
| 4,247,264 | 1/1981 | Wilden | 417/454 X |
| 4,597,721 | 7/1986 | Santefort | 417/454 X |
| 4,623,303 | 11/1986 | Henderson | 417/454 X |
| 4,679,994 | 7/1987 | Brown | 417/534 X |
| 4,773,833 | 9/1988 | Wilkinson et al. | 417/454 X |

*Primary Examiner*—Carlton R. Croyle
*Assistant Examiner*—Eugene L. Szczecina, Jr.
*Attorney, Agent, or Firm*—Sixbey, Friedman, Leedom & Ferguson

[57] ABSTRACT

In a high pressure pump (1) for liquids or gases with a drive unit (2) and a pair of pump units (3) which are connected by a drive element (4) to a drive shaft driven by a motor (6), a considerable simplification in the sense of large scale production with the lowest possible costs is achieved in that each pump unit (3) exhibits its own closed casing, separate from the drive unit (2), the casing has an inlet (8), an outlet (9), and a tight duct through which a portion of a piston, e.g., at least its piston rod, extends, the piston rods of the pump's pistons are connected to one another by a power transmission element (5) of the drive unit (2), and a solid, inherently stable supporting plate is provided, by way of which at least the casings of the pump units (3) and the drive unit (2) are fixed relative to one another.

5 Claims, 5 Drawing Sheets

MODULAR HIGH PRESSURE PUMP

BACKGROUND OF THE INVENTION

1. Field of the Invention

The invention relates to a pump for fluids of the type having a pair of identical pump units which are connected to a motor driven shaft via a drive unit that has a drive element, and a power transmission element, and having a support member to which casings of the pump units are fixed.

2. Description of Related Art

The known pump from which the invention originates (U.S. Pat. No. 3,697,197) is an ice cream pump that serves to pump liquid and air simultaneously in respective cylinders. The pressures applied in the intended use environment are low pressures from slightly above atmospheric pressure up to a maximum of 2 bar.

The noted pump is a self-contained, double-acting pump having a pair of piston cylinder pump units that are driven by a motor, such as an electric motor. The double-acting pump is connected by a flanged joint to the electric motor or the motor frame. Each pump unit, itself, is of a very practical, simple, and economical modular design. All parts of the pump are held together by a support which is made as a U-shaped frame and which is flange mounted, by a plate-like crosspiece onto a bearing bracket of the motor. Each pump unit is mounted on a respective plate-like side leg of the U-shape of the frame, with the pump units placed facing each other with mirror-image symmetry. The casings of the pump units are configured to provide a pipe-shaped part with open inlet and outlet ends for holding a suction valve or a pressure valve and a cylindrical part which projects at a right angle away from the pipe-shaped part to provide a cylinder working space for guiding the pump piston. Valve bodies of the suction valve and pressure valve are set in the end openings of the casings after which the end openings are closed with end caps. A complete bracing of all parts occurs by setting the pump units on the support.

The opening in the casings for the piston rods or the pump pistons of the pump units are placed on the long sides of the casings and are axially aligned with one another. The pump pistons are connected with a yoke-like power transmission element having a central channel section which receives a cam roller of a crank-like drive element of the drive unit. The drive element is seated on the front end of the drive shaft of the motor with the axis of rotation of the cam roller eccentric to the longitudinal axis of the drive shaft. Optionally, a suitable permanent lubrication can be provided here; although the open arrangement of this construction automatically yields good cooling, especially in the area of the drive element of the drive unit and the power transmission element.

The support of the known pump exhibits an opening for the drive shaft to pass through so that the support can be flange mounted directly onto the bearing bracket of the motor, and the power transmission element and drive element received in a space between the sides of the U-shaped frame. When an electric motor is used, for example, the bearing on the output side of the motor shaft, specifically the armature bearing on the output side of the electric motor, can be used as a bearing for the drive shaft.

The attachment of both pump units onto the sides of the U-shaped support frame occurs from the outer side of the frame, and the perpendicularly projecting part of the casing that forms the work space is inserted through a suitably shaped opening in each side leg of the U-shaped frame. Threaded rods project from the sides of the support, and the casings can be slid onto these rods and held in place with the help of threaded knobs. A flange-like edge surrounds the frame opening provided for passage of the part of the casing which provides the piston work space and acts together with a ring-like flange on the casing of each pump unit itself so that the pump units can simultaneously be aligned with one another and adjusted when the units are fixed in place.

The known pump described above is not suitable for higher pressures for many reasons. On the one hand, the necessity of connecting the two pump units of the pump with one another by hose lines in a relatively complicated operation is problematical for high pressure applications since weak points result each time from the hose lines. In any case, such hose lines are decidedly expensive for high pressures above 20 bar. Further, at high pressures, correspondingly high drive power is, naturally, needed which, of course, requires correspondingly considerably increased material strengths. That also immediately results in considerably higher prices. As a result, a pump of the kind discussed that is reinforced so that it is suitable for pressures above 20 bar becomes as expensive or more expensive than high pressure pumps of the type specially developed for these pressure ranges and designed differently.

Conventionally, high pressure pumps, in other words pumps for a pressure range between 20 and 100 bar, especially a pressure range between 40 and 80 bar, are so expensive primarily because it has been generally accepted that a large and heavy, all encompassing metal casing cannot be dispensed with. This casing is normally flanged with the motor mount of a drive motor by a further supporting structure. At the same time, a drive shaft of the high pressure pump doubly supported in the casing itself is connected by a flanged joint located between the casing of the drive motor and the casing of the high pressure pump.

SUMMARY OF THE INVENTION

The primary object of the present invention is to create a modular pump which, like the known pump with a modular design, is producible with low material and cost expenditures so that it is an economical product, yet is suitable for use at high pressures, i.e., those above 20 bar.

In the pump according to a preferred embodiment of the invention, the object indicated above is achieved by such features as the fact that the casing for each pump unit is provided with an inlet, an outlet, and a duct through which a portion of a pump piston, e.g., at least its piston rod, sealingly passes, the inlet, outlet, and duct (which is disposed between the inlet and outlet) being oriented parallel to each other and in facing relationship to the inlet, outlet, and piston duct of the other of the pump units. According to the invention, a modular pump design is usable in an economic manner since the skillful placement of the inlets and outlets on the casings of the pump units achieves extremely short and optimally straight running of all pipes, while by precisely opposing the action of the considerable forces that arise at the inlets and outlets of both pump units during pumping at high pressure enables them to mutually compensate for each other and, in any case, be optimally absorbed on the support. In fact, the casings of the pump units themselves form an optimal abutment for these forces. The result is that, for a configuration of the pump that is resistant to high pressure because of the structural arrangement of the individual parts according to the invention, a stable configuration of the casings and a stable configuration of the support are sufficient to make the production costs considerably lower than with the previously known high pressure pumps exhibiting an integral casing.

Basically, the modular pump described above can operate with only one pump unit in the high pressure range, but for reasons of dynamic and static optimization two symmetrical pump units would usually be chosen, as is also always done in the prior art. With regard to the pressure and suction valves, it is recommended that they be completely integrated in the casing, i.e., to make them as removable screw plugs as are known for high pressure pumps.

Various possibilities for elaborating and developing upon the teachings of the invention exist. Of these, one teaching of the invention takes on a particular and independent meaning, and according to which the support is made as a solid, inherently stable supporting plate. In the scope of this aspect of the invention, a particular simplification in the desing of the pump, and thus an independent solution of the object, is achieved by making the support no longer as a U-shaped frame but, instead, as a flat supporting plate. In developing the present invention, it was recognized that the sides of the known U-shaped support contribute nothing at all to the exact location of the relative position of the individual parts of the pump, and that such positioning can be achieved very precisely if the support is merely a flat supporting plate and the casings of the pump units are suitably configured somewhat differently. Use of such a supporting plate saves considerable material and a significant cost reduction is brought about. Further, this gives rise to the possibility of using a correspondingly configured bearing bracket of a motor as this supporting plate, and eliminates the need for a separate supporting plate, the individual parts of the pump being fastened directly to the bearing bracket of the electric motor.

These and further objects, features and advantages of the present invention will become more obvious from the following description when taken in connection with the accompanying drawings which show, for purposes of illustration only, a single embodiment in accordance with the present invention.

DETAILED DESCRIPTION OF THE PREFERRED EMBODIMENT

Figure 1:
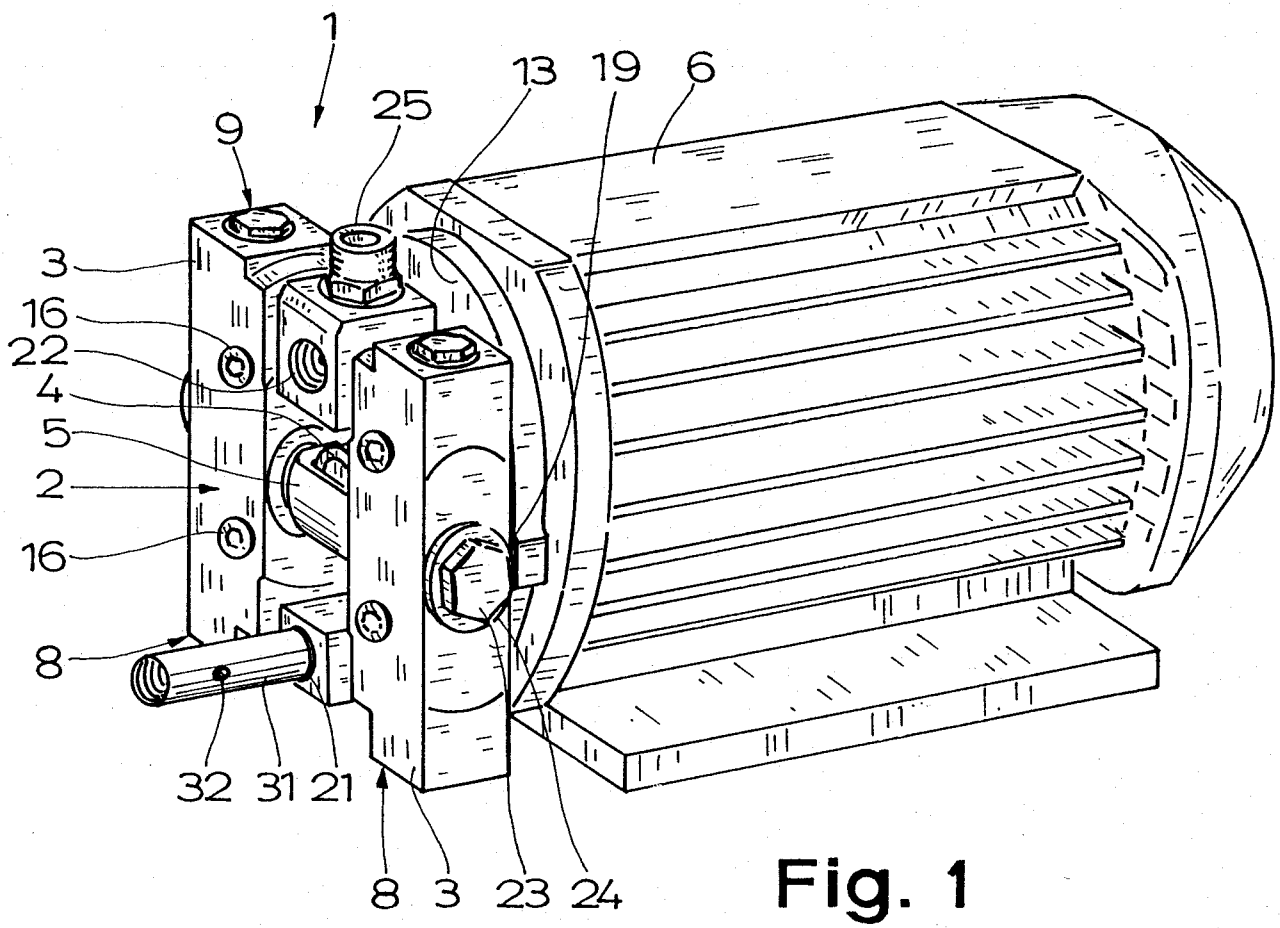
FIG. 1 is a perspective view diagrammatically illustrating a preferred embodiment of a high pressure pump that is flange mounted onto an electric motor in accordance with the present invention.

Shown is a pump 1 for liquids or gases, especially for water, that is provided with a drive unit 2 and at least one pump unit 3 connected to a drive unit 2. As illustrated relative to the preferred embodiment, two identical pump units 3 are placed symmetrically with respect to drive unit 2 and are connected to drive unit 2. Drive unit 2 is comprised of a drive element 4 which is in the form of an eccentric cam (shown by a broken line in FIG. 5), and a power transmission element 5 (also shown in FIG. 5) which engages with drive element 4 and, in the illustrated embodiment, is designed as a channel-like cage for the eccentric cam 4. A drive shaft 7 that is driven by a motor, particularly an electric motor 6, is, like cam 4, shown by a broken line in FIG. 5.

Rotation of drive shaft 7 is converted into a sliding motion in drive unit 2. But basically drive unit 2 can also be configured for use with a driving motor whose output is in the form of a reciprocating motion, so that a conversion from rotary to reciprocating motion within drive unit 2 is no longer necessary.

Each pump unit 3 has an internal working space forming a cylinder within which a piston reciprocates, as is known in the art and thus not shown in detail beyond a schematic depiction. A suction valve is placed between the working space and an inlet 8 and a pressure valve is placed between the working space and an outlet 9. Such valves 8, 9 may be of any conventional design (such as a check valve design as used in the above-noted U.S. Pat. No. 3,697,197) and may be inserted into bores in casing 10 that are then sealed by threaded-in plugs 8', 9', respectively, or, as preferred, may be integrated into plugs 8', 9', themselves, such plugs being known, per se, for high pressure pumps. Furthermore, each pump unit 3 includes a pump piston which is guided in sealed relationship to the working space and is movable back-and-forth in the working space for pumping. The pump pistons are driven by motor 6 via drive unit 2. The flow circuit within the pump units 3 is schematically depicted on the left pump unit casing 10 in FIG. 5.

Figure 5:
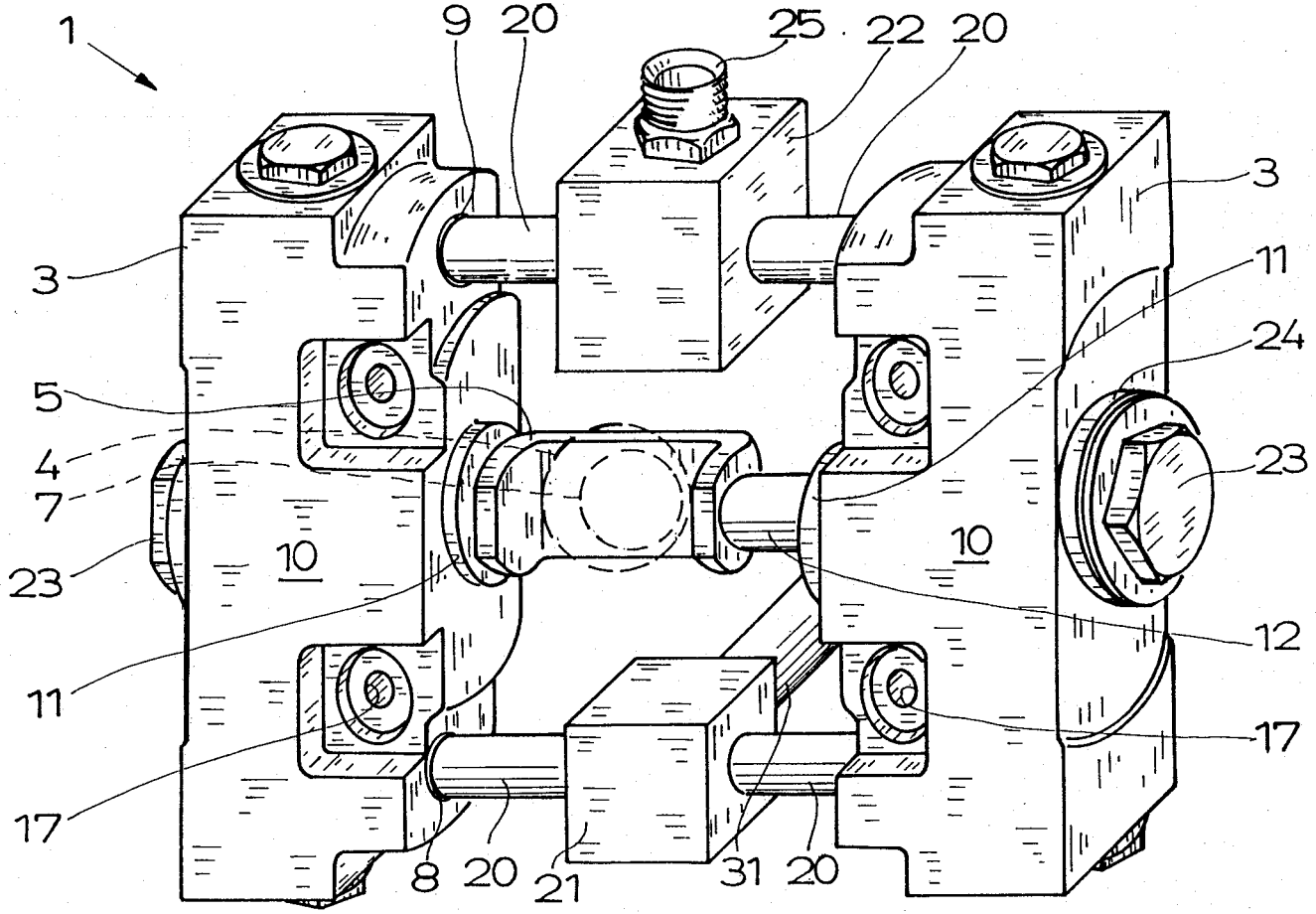
FIG. 5 is a perspective view of the preferred embodiment pump as seen from the rear side, which faces the motor in FIGS. 1 and 2.

FIGS. 1 and 5 show that each pump unit 3 has its own elongated, block-like or cylindrical casing 10 with the working space, inlet 8, the suction valve, here integrated with casing 10 within inlet 8, outlet 9, the pressure valve, her also integrated in casing 10, within outlet 9, the pump piston and a presure sealed duct on a longitudinal side of casing 10, for a piston rod 12 connected with the pump piston 11 or forming the pump piston.

Significantly, drive unit 2 is made without a casing and, thus, consists only of piston rods 12, power transmission element 5, and drive element 4. The mutual relative position of these parts is guaranteed by an inherently stable support 13, with which casings 10 of pump units 3 are permanently connected in a precisely determined position. The special advantages of this construction in a modular design have already been explained above. That is, the support 13 is a foundation for a pump 1 that is easily and inexpensively producible, in a manner suitable for use at high pressures, i.e., in a range over 20 bar, as a true high production volume product.

The elongated block-like or cylindrical form of casings 10 lays the foundation for a frame-like, and thus especially torsion resistant construction, of pump 1. It is then essential for the invention that, for each pump unit 3, inlet 8 and outlet 9 is also placed on an end of the longitudinal side of casing 10 which contains the duct for piston 11 with the longitudinal axes of inlet 8 and outlet 9 aligned parallel to the longitudinal axis of the duct for piston 11 and placed facing on support 13 facing those of the other casing 10. This is clearly shown by FIG. 5 in combination with FIG. 1. Further, here the ducts for pistons 11, inlets 8, and outlets 9 of the two-pump units 3, are all axially aligned with one another, respectively. This results in an extremely torsion resistant, frame-like construction having only straight, relatively short, pieces of pipe extending between the pair of inlets 8 and between the pair of outlets 9 of casings 10, and the advantages explained above concerning absorption of the forces occurring during pump operation. The preferred construction and placement of casings 10 of pump units 3 on support 13, explained above, lead to a slight change in the distance of pump units 3 from one another that is basically insignificant relative to the alignment of inlets 8, outlets 9, and ducts 11.

Adapted to the previously explained construction and arrangement of casings 10 of pump units 3, it is further provided that inlets 8 and outlets 9 of casings 10 of pump units 3 are connected by a collecting pipe 20, each with one another and with a central inlet 21 or a central outlet 22. Collecting pipes 20 are made of straight pipe pieces, and the central inlet 21 and/or central outlet 22 is made as a T-piece. Finally, it is shown here that inlets 8 and outlets 9 of casings 10 are made with tight plug-in sockets for the ends of collecting pipes 20. This configuration of the hydraulic connection of the two pump units 3 leads to both casings 10 of pump units 3 being able to be easily adjusted in their distance from one another without leaks occurring. The sockets of inlets 8 and outlets 9, by providing a slide fit for the collecting pipes 20, allow the distance of pump units 3 to be changed over a relatively large range without changing the relative angle of pump units 3. For this purpose, collecting pipes 20 in the plug-in sockets of inlets 8 and outlets 9 serve to adjust the angle of casings 10 of pump units 3.

Figure 2:
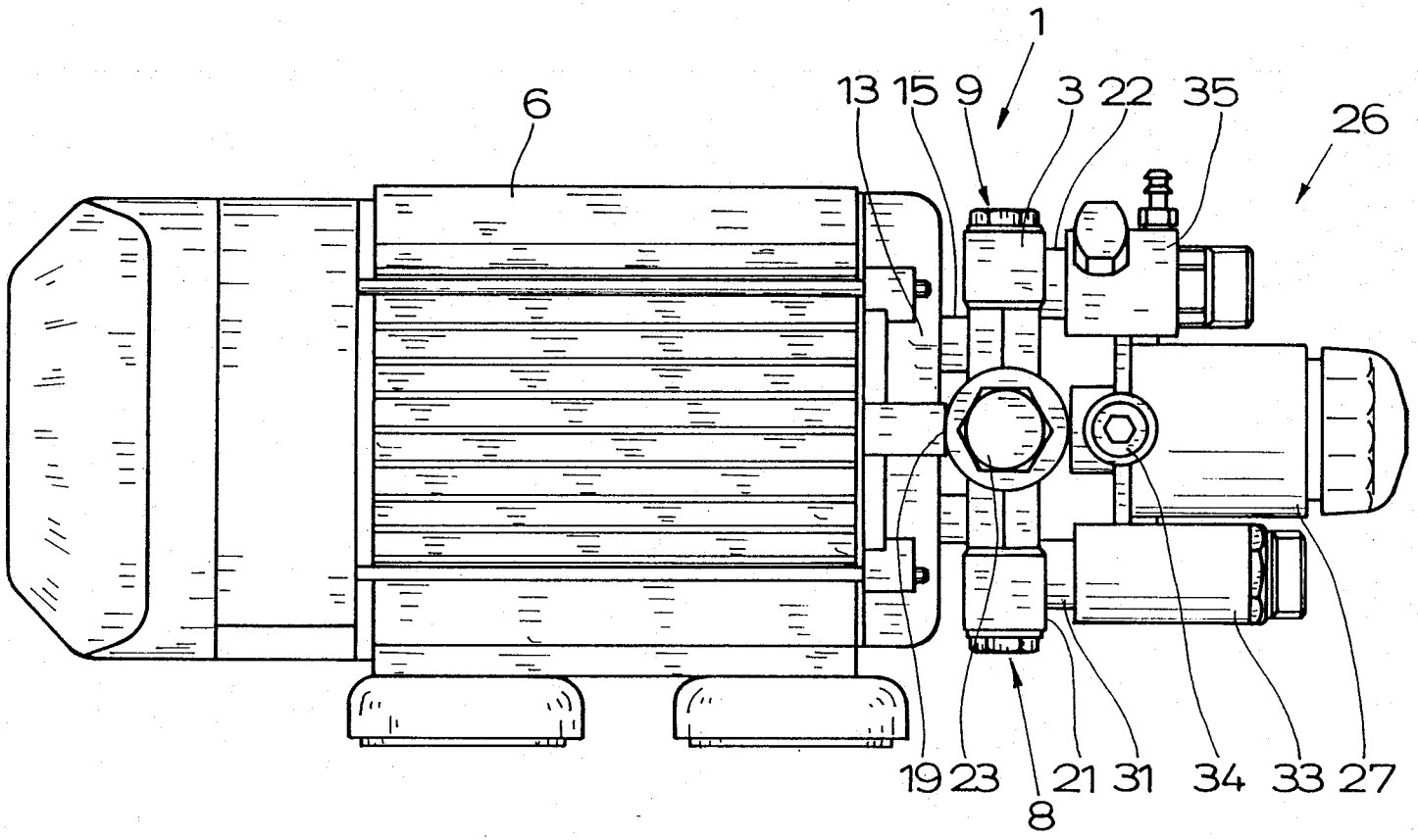
FIG. 2 is a side view diagrammatically illustrating the flange-mounted high pressure pump of FIG. 1 with a bypass device attached thereto.

In addition, FIG. 1 in combination with FIG. 2 makes it clear that the longitudinal axes of central inlet 21 and central outlet 22 are oriented parallel to each other. In FIG. 5 it can also be seen that still another connection 25 for either a separate connection pipe or a pulsation damper can definitely also be present.

Sometimes, for example, in a one-piece embodiment of casing 10, but also for reasons of cleaning and repair, it can be desirable to make the working space in casing 10 of pump units 3 freely accessible. For this purpose, in the illustrated embodiment, casing 10 of each pump unit 3 has an opening 24, on the side thereof opposite that having the duct for piston 11 and/or piston rod 12, that is closed by a screw cap 23.

Up to this point, it has only been alluded to that casings 10 of pump units 3 must be fixedly connected with support 13. This fixed connection is guaranteed, in the embodiment shown, by screw attachments, to be explained in more detail later. Not shown in the drawings is that the casings of the pump units can be formed as one piece with the support, i.e., can be formed as a one-piece cast part or a pressed part integrating the support with the casings. As a material, brass, aluminum, possibly also modern plastics, for example polyacetal, are suitable.

In the prior art, as has been explained above, support 13 is U-shaped. That is expensive, especially from a material consumption standpoint. But according to a separate and independent teaching of the present invention, support 13 is now, in pump 1, made of a solid supporting plate. This has the further advantages explained above and achieves the object in an independent way.

The embodiment of support 13 as a solid supporting plate has the further advantage that, as shown here, support 13 can be formed from the correspondingly configured bearing bracket of motor 6. This, of course, produces a significant cost-saving since the bearing bracket, which is present anyway and configured very solidly, now simultaneously serves as a solid backbone for the arrangement of the individual parts of pump 1. Thus, weight and costs of a separate support 13 are completely saved.

In pump 1, support 13 has an opening 14 for drive shaft 7 to pass through to power transmission element 5 of drive unit 2. This is especially clear in FIG. 3 and FIG. 4. A special bearing for supporting drive shaft 7 in support 13, made as a supporting plate, is not needed here in an especially suitable way because support 13 is, in fact, the bearing bracket of electric motor 6. The bearing of drive shaft 7 is thus, in fact, the output end of the armature bearing of electric motor 6. Thus, pump 1 itself needs no further bearing at all for its drive shaft 7. The armature bearings of electric motor 6 are, thus, used in a double way, on the one hand as the armature bearing of the output shaft of electric motor 6, and on the other hand, functionally, as the pivot bearing of the drive shaft of pump 1.

Figure 3:
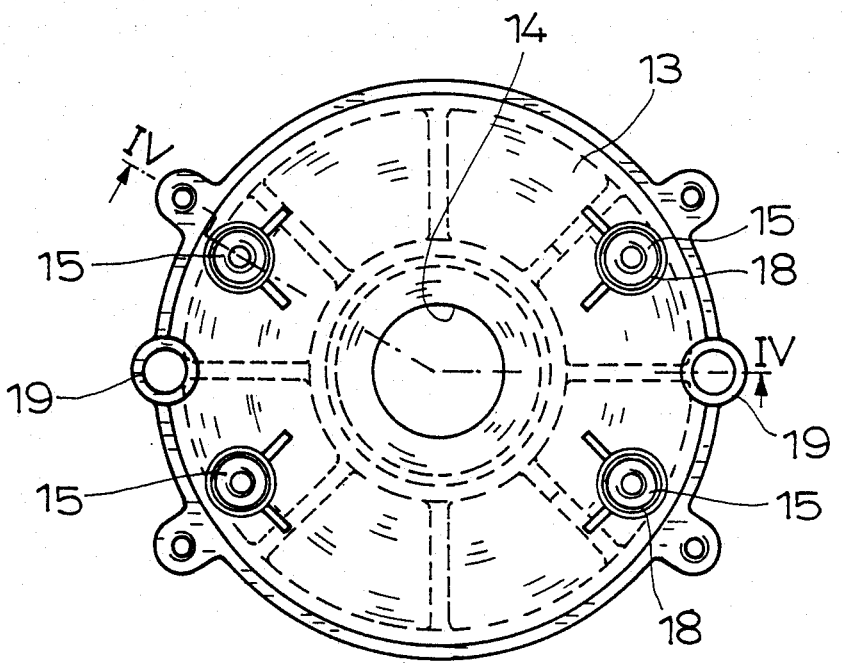
FIG. 3 is a front view of a supporting plate of the pump of the preferred embodiment.
Figure 4:
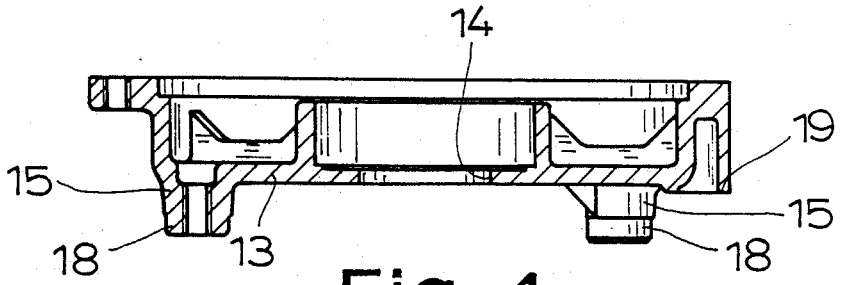
FIG. 4 is a sectional view taken along line IV—IV of FIG. 3.

FIGS. 3 to 5 show how casings 10 can be connected with support 13. Here, welded joints, soldered joints, clamped joints, interlocked joints, etc. could be provided, but in the illustrated embodiment screw attachments 15 are utilized. These screw attachments 15 could include threaded shafts as used in the prior art, but in the embodiment shown, support 13 has two threaded pipes as screw attachments 15 for each pump unit 3, and into which fastening screws 16 can be threaded. Casings 10 of pump units 3 have corresponding through holes 17 for fastening screws 16. In this connection, it is especially desirable that the screw attachments 15 and through holes 17 exhibit correspondingly formed centering surfaces 18. These centering surfaces 18 are advantageously slightly conical in shape to facilitate the placement of pump 1 on support 13. This provision of the threaded pipes allows an especially practical integration thereof in a support 13 made as a solid supporting plate.

As has been addressed several times above, support 13, here in the form of a bearing bracket of electric motor 6 serves, in a manner of speaking, as the backbone of pump 1. That is, the exact mutual relative position of the various operating assemblies of pump 1 is guaranteed by support 13. As a result, the operating assemblies, particularly pump units 3, must be able to be brought into a very exact relative position to support 13. Aligning surfaces 19, seen in FIGS. 2 and 3, are precisely dimensioned and made to be as wear-resistant as possible to serve this purpose.

Casings 10 can be clamped against aligning surfaces 19 with the help of fastening screws 16. The angle of pump units 3 relative to one another and to drive unit 2 can be optimally set by interaction of the pump 1 with centering surfaces 18 on the one hand, and aligning surfaces 19 on the other hand. During operation, considerable tilting forces are exerted by the forces occurring on casing 10 and, without countermeasures, these tilting forces would cause casing 10 to tip over. So as not to make the tilting forces to be absorbed completely by fastening screws 16, threaded pipes 15, and centering surfaces 18, pump 1 is designed so that aligning surfaces 19 are placed beyond screw attachments 15, preferably as far beyond as possible, in a direction radially outward with respect to drive unit 2. With this measure, the longest possible lever arm exists between aligning surfaces 19 and fastening screws 16, so that all tilting forces can be diverted through this lever arm into aligning surfaces 19, and thus into support 13. This assures that fastening screws 16 are not strained to the point of bending. Even in full load operation, such an exact retention of the relative angle of pump units 3 to one another and to drive unit 2 is assured.

As in the prior art, the power transmission element of the present invention is designed to shift laterally back-and-forth to move the pistons of the pump units by the action of the cam roller drive element received in a U-shaped channel section of the power transmission element. As clearly shown in FIG. 5, as a preferred embodiment, drive element 4 is a cam roller received by element 5. Such cam rollers can be obtained commercially and, in the final analysis, represent nothing more than a cylinder jacket shaped outer ring of a highly wear-resistant material which can turn on a ball bearing or a roller bearing, sealed on all sides, relative to a concentrically placed inner ring. Usually a filling of permanent lubricant is provided at the same time. The inner ring can be attached, stationarily, at any point. This construction of drive element 4 is an especially suitable way to shift power transmission element 5 and is given a size corresponding with the essentially U-shaped channel section.

FIG. 5 shows, by broken line representation, drive element 4 and drive shaft 7, element 4 being mountable by an especially simple and suitable attachment on drive shaft 7, which is also suitable, in a quite special way, for the case where drive shaft 7 is formed by the output shaft of electric motor 6. In fact, here the cam roller which forms drive element 4 and which, with its axis of rotation eccentric to the longitudinal axis of drive roller 7, is mounted offset on the front side of drive shaft 7. However, it is noted that this mounting of the drive element 4 corresponds to that shown in FIG. 3 of U.S. Pat. No. 3,697,197 with respect to the mounting of its crank to its drive shaft. The surfaces of contact between drive element 4 and power transmission element 5 consist of wearresistant and/or self-lubricating materials, especially those containing graphite.

Figure 6:
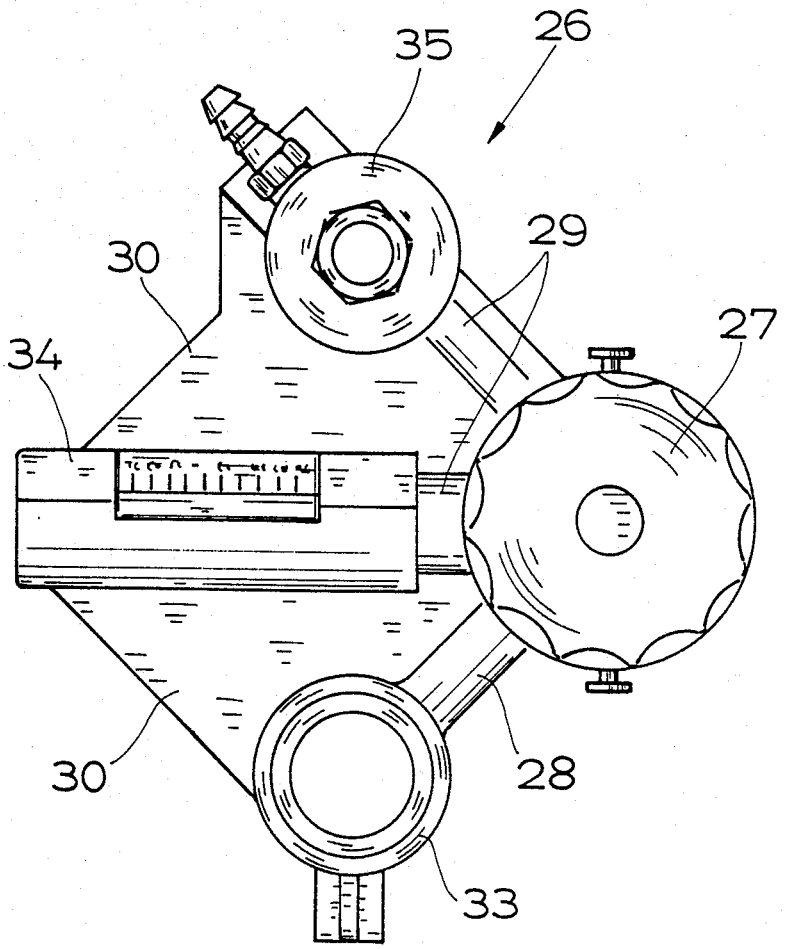
FIG. 6 is a front end view of the bypass device, i.e., as seen from the side facing away from the motor in FIG. 2.

FIG. 2 shows that pump 1 is connected downstream to a bypass device 26, such as is known from the prior art. Bypass device 26 is connected hydraulically between central outlet 22 and central inlet 21 and has an excess pressure valve 27 connected downstream to central outlet 22 and a return pipe 28 leading from excess pressure valve 27 to central inlet 21. FIG. 6 shows bypass device 26 somewhat more precisely. From there it can be seen that bypass device 26 is also made as an open structure; in other words, with an exposed excess pressure valve 27, exposed return pipe 28, connection pipes 29, etc. In this case, bypass device 26 is primarily formed of plastic, especially of polyacetal, and is made preferably as an injection molded part, although individual parts can be made as screw plugs of metal, as it is known in itself for comparable structures. Further, FIG. 6 shows that the individual parts of bypass device 26 are connected to each other and braced by bracing crosspiece 30.

FIG. 2 shows how bypass device 26 can be joined to pump 1. FIG. 1 in combination with FIG. 5 shows that, in the embodiment shown here, central inlet 21 has an elongated connection piece 31. This elongated connection piece 31 can now be used in combination with a corresponding form of central outlet 22, to fasten bypass device 26 to pump 1. For this purpose, elongated connection piece 31 has a lateral bore hole 32, so that liquid from the outside can enter connection piece 31. As clearly shown, especially by FIG. 2, an elongated sleeve 33 is also provided. Return pipe 28 from excess pressure valve 27 empties into sleeve 33. If sleeve 33 is pushed over connection piece 31 when bypass device 26 is connected, bore hole 32 is approximately in alignment, flush with the mouth of return pipe 28 in sleeve 33.

Bypass device 26 also contains a pressure gauge 34 that is associated with excess pressure valve 27. Excess pressure valve 27, as such, is made of conventional construction, such as a piston valve with two piston surfaces of different size. Further, after central outlet 22, an injection unit 35 is also inserted which operates like a water jet pump and allows the injection or drawing in of chemicals into the pumped liquid.

Very generally, casing 10, collection pipes 20, etc. consist optionally of cast or stamped brass, aluminum or the like, or of plastic, especially polyacetal.

While we have shown and described an embodiment in accordance with the present invention, it is understood that the same is not limited thereto, but is susceptible of numerous changes and modifications as known to those skilled in the art, and we, therefore, do not wish to be limited to the details shown and described herein, but intend to cover all such changes and modifications as are encompassed by the scope of the appended claims.

We claim:

1. A high pressure pump for fluids of a frame-like modular construction having a pair of identical piston pump units, each of which is comprised of an elongated block-like casing within which a working space is provided, reciprocating pump pistons of which are connected to each other and to a motor via a drive shaft and a drive unit that has a drive element and a power transmission element extending between the pistons, and said pump also having a support member to which said elongated block-like casings of the pump units are fixedly connected; wherein an inlet and outlet of each pump unit is disposed at a respective end portion of the respective casing of the pump unit and a duct, through which a portion of the respective pump piston sealingly passes through the casing to move back-and-forth within said working space, is disposed between the inlet and outlet, said inlet, outlet, and duct of each pump unit being oriented parallel to each other on a longitudinal side of the respective casing and the inlet, outlet, and duct of one pump unit being axially aligned with the respective inlet, outlet, and duct of the other pump unit, said inlet and outlet of each pump unit being connected by a respective collection pipe to a common central inlet and a common central outlet, respectively, each of the collection pipes being a straight pipe piece and the central inlet and central outlet being T-pieces, and said inlets and outlets of the pump units being formed with sealed plug-in sockets for the ends of the collection pipes.

2. Pump according to claim 1, wherein the casing of each pump unit, on an opposite side from said duct, has an opening for providing access to a work space for the piston that is closed by a screw cap.

3. Pump according to claim 2, wherein said support has two screw attachments per pump unit and said casing has a pair of through holes through which threaded fasteners extend to said screw attachments, and wherein said screw attachments are made as threaded pipes having centering surfaces which match centering surfaces of the casings surrounding said through holes.

4. Pump according to claim 1, wherein said support has two screw attachments per pump unit and exactly dimensioned aligned surfaces, said casings of the pump units being clamped against said aligning surfaces by means of said screw attachments, and wherein said aligning surfaces are disposed radially outward of said screw attachments relative to said drive shaft, as far as possible.

5. Pump according to claim 1, wherein the support member is formed by a bearing bracket of said motor, said motor being an electric motor.

* * * * *